US005197739A

United States Patent [19]

Johnson, III

[11] Patent Number: 5,197,739

[45] Date of Patent: Mar. 30, 1993

[54] GOLF TRAINING DEVICE

[76] Inventor: James M. Johnson, III, 11545 SW. Beef Bend Rd., Apt. 65, Tigard, Oreg. 97224

[21] Appl. No.: 884,620

[22] Filed: May 15, 1992

Related U.S. Application Data

[63] Continuation of Ser. No. 735,902, Jul. 25, 1991, abandoned.

[51] Int. Cl.[5] ..... A63B 69/36

[52] U.S. Cl. ..... 273/187 B; 273/187 R; 273/188 A; 273/188 R

[58] Field of Search ..... 273/32 C, 187 R, 187 B, 273/188 R, 188 A, 195 R, 195 B; 434/252; 36/114, 115, 127

[56] References Cited

U.S. PATENT DOCUMENTS

| | | | |
|---|---|---|---|
| 3,363,903 | 1/1968 | O'Brien | 273/187 B |
| 3,698,721 | 10/1972 | Stewart | 273/188 R |
| 3,937,473 | 2/1976 | Blasi | 273/188 R |
| 3,955,821 | 5/1976 | Spedding | 273/187 B |
| 4,147,356 | 4/1979 | Brandell | 273/187 B |
| 4,164,352 | 8/1979 | O'Brien | 273/187 B |
| 4,322,084 | 3/1982 | Reece et al. | 273/187 R |
| 4,817,953 | 4/1989 | Ponchak | 273/188 R |
| 4,900,030 | 2/1990 | Houtz | 273/183 E |
| 4,917,385 | 4/1990 | Brown | 273/187 B |

*Primary Examiner*—V. Millin
*Assistant Examiner*—Steven B. Wong
*Attorney, Agent, or Firm*—John F. Ingman

[57] ABSTRACT

A golf training device provides a stepped surface upon which the golfer places his rear foot and a wand which extends in proximity to the rear hip. The golf training device inlcudes a base member which is placed upon the floor or ground. The upper surface of the base member, at the location of the rear foot of the golfer, includes a single step with the lower level beneath the inside edge of the foot and the upper level beneath the outside edge of the foot, the step itself being located approximately along the longitudinal center-line of the foot's position. Extending upwardly from the surface of the base member, a wand, positioned to be proximate the rear hip of the golfer during the normal pre-swing stance, indicates substantial body sway during the backswing by contact with the hip. The base member may include an artificial grass-like upper surface.

10 Claims, 2 Drawing Sheets

GOLF TRAINING DEVICE

This is a continuation of application Ser. No. 07/735,902, filed on Jul. 25, 1991, now abandoned.

BACKGROUND OF THE INNVENTION

1. Field of the Invention

The invention involves a training device for golfers, and, more particularly, a training device designed to detect and prevent undesirable hip and body sway during the golf swing.

2. Description of the Prior Art

It has been long recognized that the development of a proper golf swing includes the prevention of undesirable sway during the backswing. Certain golf training devices which address this problem have been previously designed. U.S. Pat. No. 4,322,084 describes an adjustable framework to establish a correct golfing stance, which includes an anti-sway wedge upon which the rear foot is placed "in order to prevent the golfer from shifting the body weight to the outside of the rear foot during the back swing." However, no indicator is provided for the golfer to assess whether backswing sway has properly been eliminated. U.S. Pat. Nos. 3,955,821 and 4,147,356 include, as part of a rigid structure, a slanted foot rest with an upward extending lower edge for the rear foot and a rigid horizontal leg brace which engages the lower portion of the leg and physically prevents any rearward motion by that portion of the leg. However, such rigid devices are not effective in permitting the golfer to complete a full practice swing because they lock the foot into a fixed position and do not permit the natural turning, coiling, and pushing off movement associated with a full swing.

The previous training devices provide a wedge or slanted foot rest for the rear foot of the golfer which has an even slope. This even slope will, in the pre-swing stance, place weight on the inside of the rear foot. However, during the swing, the golfer may, unknowingly, transfer his weight to the outside edge of the rear foot, with the slope of the training device restraining the foot from actually rolling onto its outside edge. When the golfer swings in actual play, he may continue the habit of shifting his weight to the outside edge of the rear foot, which now, without the slope, is able to roll outwards, thus permitting undesirable sway of the golfer's body.

What is needed is a golf training device which:

(1) places pre-swing weight on the inside of the rear foot, yet provides notice to the golfer if weight is shifted to the outside of the foot;

(2) does not restrict a natural free swing; and (3) provides the golfer an explicit indication of improper body sway during the backswing.

SUMMARY OF THE INVENTION

The present invention involves a golf training device which has been designed to meet the aforementioned needs. The golf training device provides a stepped surface upon which the golfer places his rear foot and a wand which extends in proximity to the rear hip.

Accordingly, in the preferred embodiment, the golf training device includes a base member which is placed upon the floor or ground. The upper surface of the base member, at the location of the rear foot of the golfer, includes a single step with the lower level beneath the inside edge of the foot and the upper level beneath the outside edge of the foot, the step itself being located approximately along the longitudinal center-line of the foot's position. Extending upwardly from the surface of the base member, a wand, positioned to be proximate the rear hip of the golfer during the normal pre-swing stance, indicates substantial body sway during the backswing by contact with the hip. The base member may include an artificial grass-like upper surface.

DESCRIPTION OF THE PREFERRED EMBODIMENT

Figure 1:
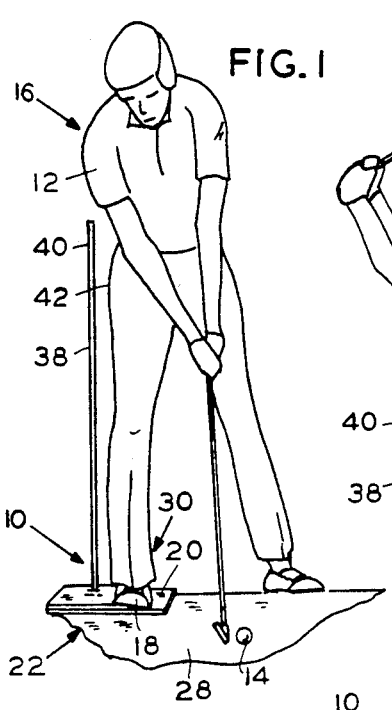
FIG. 1 illustrates a perspective view of the golf training device in use, with the golfer in a normal pre-swing stance.
Figure 2:
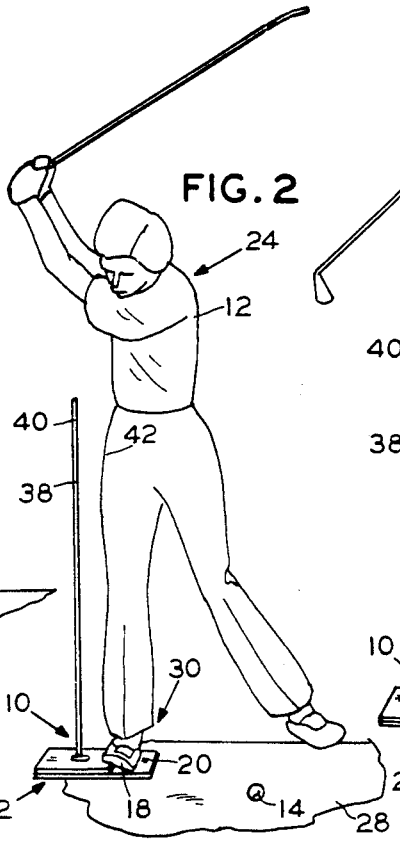
FIG. 2 illustrates a perspective view of the golf training device in use, with the golfer in his backswing without undesirable body sway.
Figure 3:
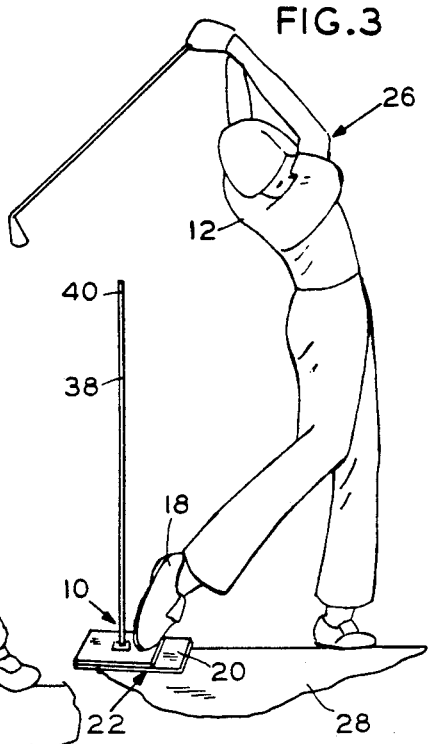
FIG. 3 illustrates a perspective view of the golf training device in use, with the golfer during the follow-through of his swing.
Figure 4:
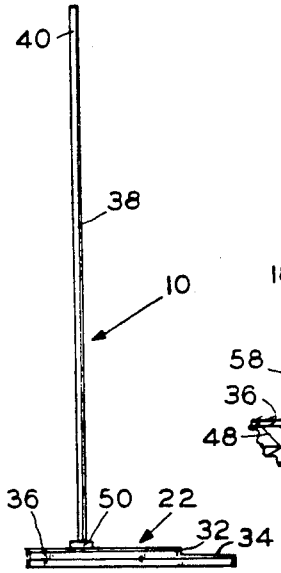
FIG. 4 illustrates a side elevation view of the golf training device.
Figure 5:
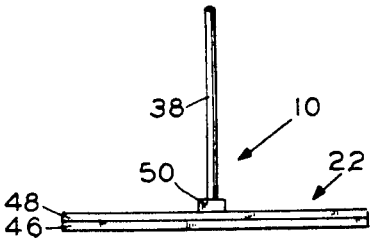
FIG. 5 illustrates a partial front elevation view of the golf training device.

Turning now to the drawings, there is shown in FIGS. 1, 2, and 3 various stages of a golf swing using the golf training device 10. In FIG. 1, the golfer 12 is addressing the ball 14 in a pre-swing stance or position 16. His rear foot 18, the right foot for a right-handed golfer as illustrated, is placed upon the upper surface 20 of the base member 22, as better seen in FIGS. 8 and 13, and described subsequently. FIG. 2 shows the golfer 12 during the backswing 24 and FIG. 3 shows the golfer 12 in a follow-through position 26. Of significance in FIG. 3 is that the golfer 12, with the golf training device 10, is able to complete a normal golf swing, including follow-through, without physical impediment which is present on certain prior art training devices.

FIGS. 4 through 7 provide various views of the preferred embodiment of the golf training device 10. A base member 22 is designed to be placed directly upon the ground, floor, or other supporting surface 28. Its upper surface 20 is formed, at the position 30 for the rear foot 18, to include a step 32 between a lower level 34 and an upper level 36, both levels 34, 36 being essentially horizontal. An elongated member, preferably in the general form of a wand 38, is attached to the base member 22 and extends from the upper surface 20 so that, with the golfer 12 in the normal pre-swing position 16, the upper end 40 of the wand 38 will be proximate the rear hip 42 of the golfer 12. The wand 38 preferably is resilient connected to end base member 22 so that, if its upper end 40 is pushed by the rear hip 42 of the golfer 12, it subsequently will return to its original position. While such resilient connection could be accomplished by a spring apparatus or the like, it is preferred to insert the wand 38 into a hole 44 formed in a base member 22 which itself has resilient properties. This would not preclude, of course, use of a wand 38 which is formed of a resilient material such as fiberglass.

The base member 22 is preferably formed of rubber which provides weight and flexibility for stability upon the supporting surface 28. It has been found to be convenient to form the base member 22 with three layers of rubber, a lower layer 46, approximately ¼-inch in thickness which rests upon the supporting surface 28 and forms the basis for the lower level 34 of the upper surface 20, a second layer 48 of ¼-inch thickness which forms the basis for the upper level 36 of the upper surface 20, and a third or upper layer 50, approximately ¼- to ½-inch thick, which is placed at the location of the hole 44 so as to provide additional support for the inserted wand 38. While such layering construction is currently preferred, a monolithic molded base member 22 could ultimately be a preferred form. Although not necessary, it may be desirable to provide a more natural appearance to the upper surface 20 by covering the base member 22 with a thin layer of simulated grass 52, as found in certain outdoor carpets. In the preferred embodiment, the base member 22 is approximately 12-inches wide by 22-inches long. The length of 22-inches allows use of the golf training device 10 by either right-handed or left-handed golfers 12 with their right or left rear foot 18, respectively, placed upon the base member 22. The preferred location of the hole 44 in supporting an upwardly extending wand 38 is five-inches from the step 32, as shown at 54 in FIG. 6; such position normally places the upper end 40 of the wand 38 approximately two to three inches to the outside of the rear hip 42 of the golfer 12 in the pre-swing position 16.

Figure 13:
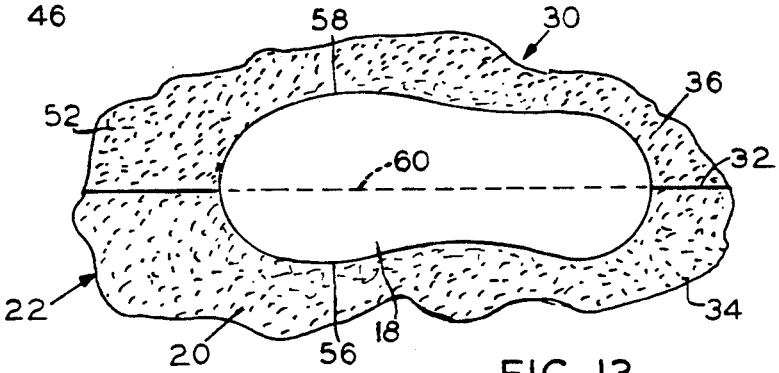
FIG. 13 illustrates a schematic plan view of the position of the golfer's rear foot upon the golf training device.

The use and advantage of the golf training device 10 are in the elimination of body sway during the golf swing. As described above, in FIG. 1 the golfer 12 is addressing the ball 14 in a pre-swing position with his rear foot 18 placed upon the upper surface 20 of the base member 22. The proper position 30 for the rear foot 18 upon the upper surface 20 is with the lower level 34 of the base member 22 beneath the inside edge 56 of the rear foot 18, the upper level 36 of the base member 22 beneath the outside edge 58 of the rear foot 18, and the step 32 lying generally beneath the longitudinal center line 60 of the rear foot 18. In such a position 30, with the golfer 12 placing weight on the inside edge 56 of the rear foot 18, the inside edge 56 will contact the lower level 34 of the base member 22 and the outside edge 58 will be suspended above the upper level 36 of the base member 22. This is the position 30 illustrated in FIG. 8. FIG. 13 further illustrates the position 30 of the rear foot 18 upon the upper surface 20 of the base member 22.

Figure 8:
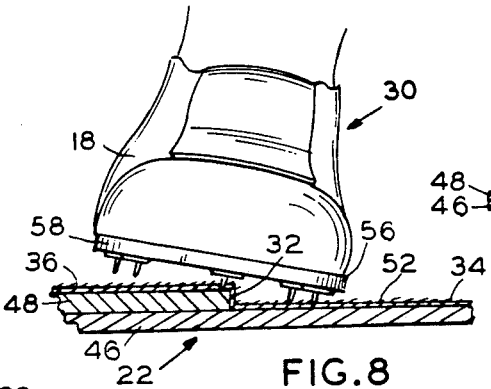
FIG. 8 illustrates an enlarged view of the golfer's rear foot upon the golf training device as seen in FIGS. 1 and 2.
Figure 7:
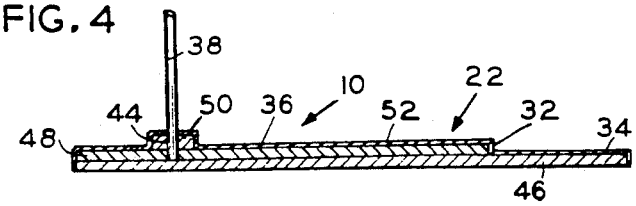
FIG. 7 illustrates a partial cross sectional view as seen at line 7—7 of FIG. 6.
Figure 6:
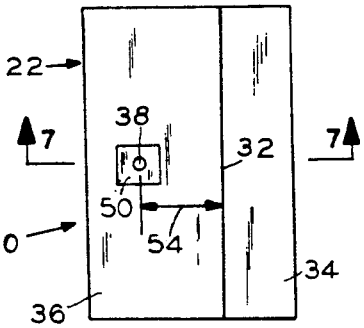
FIG. 6 illustrates a plan view of the golf training device.
Figure 9:
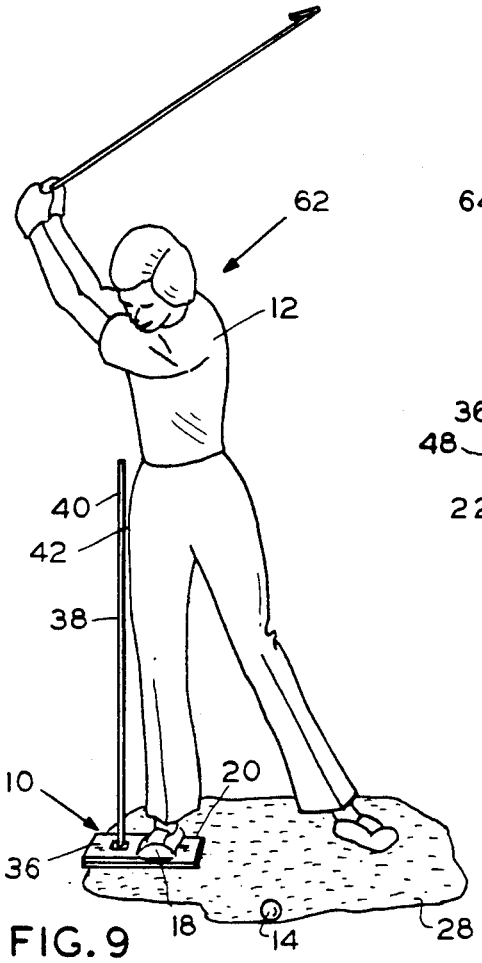
FIG. 9 illustrates a perspective view of the golf training device in use, with the golfer in his backswing with moderate body sway.
Figure 10:
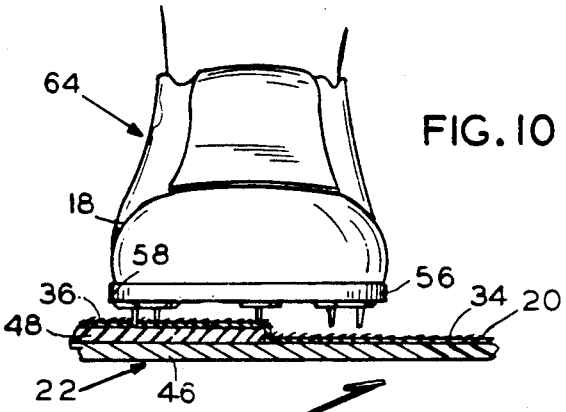
FIG. 10 illustrates an enlarged view of the golfer's rear foot upon the golf training device as seen in FIG. 9.

What is desired in preventing undesirable body sway is for the golfer 12, during the backswing 24, to maintain his weight on the rear foot 18 upon the inside edge 56 so that the rear foot 18 will not roll onto the outside edge 58. Thus, in the correct backswing 24, illustrated in FIG. 2, the rear foot 18 remains in the position 30 illustrated in FIG. 8. FIG. 9, however, shows the golfer 16 in a backswing 62 where some body sway has occurred, the rear hip 42 of the golfer 12 approaching the upper end 40 of the wand 38. This occurs when the weight on the rear foot 18 has not, during the backswing 62, been maintained on the inside edge 56, but rather has shifted toward the outside edge 58. The rear foot 18 thus has pivoted about the step 32 to the position 64 as shown in FIG. 10. It should be appreciated that the shift to foot position 64 may represent an otherwise difficult to detect shift in weight, which may create only a minor, yet undesirable, shift in the position of the rear hip 42 during that backswing 62. However, the golfer 12 is able to feel, through the rear foot 18, this pivoting of the rear foot 18 about the step 32 and therefore becomes aware that he is not correctly maintaining the weight on the inside edge 56 thereof. Thus the golf training device 10 provides an indication, through a rocking sensation in the rear foot 18, that the proper weight distribution has not been maintained.

Figure 11:
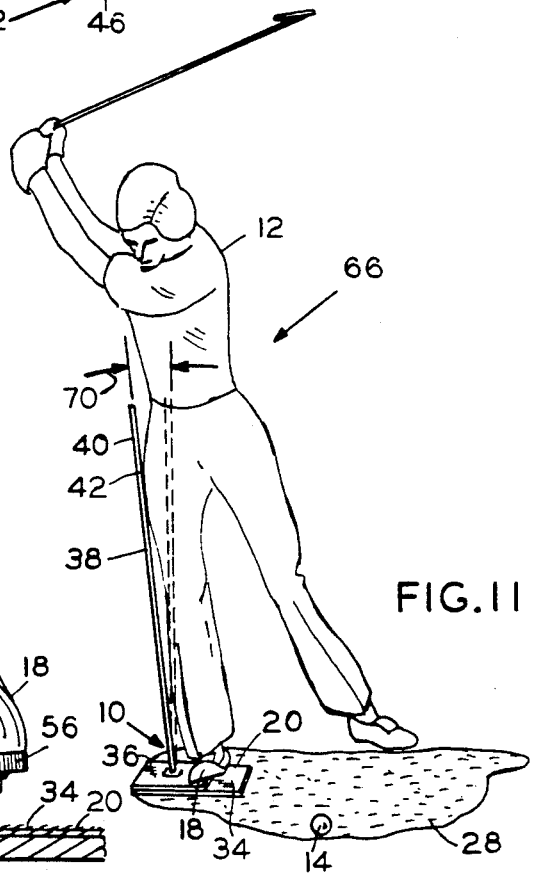
FIG. 11 illustrates a perspective view of the golf training device in use, with the golfer in his backswing with substantial body sway.
Figure 12:
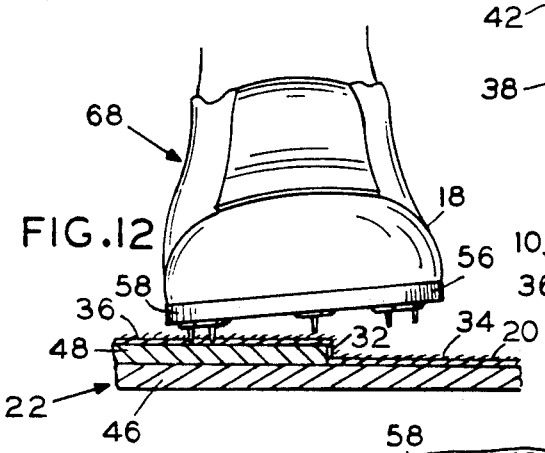
FIG. 12 illustrates an enlarged view of the golfer's rear foot upon the golf training device as seen in FIG. 11.

FIGS. 11 and 12 illustrate the occurrence, while using the golf training device 10, of a backswing 66 where a major shift in weight to the outside edge 58 of the rear foot 18 occurs so that the rear foot 18 does, in fact, roll up onto its outside edge 58. This foot position 68 creates sufficient body sway so as to have the rear hip 42 press the wand 38, as seen at deflection 70 in FIG. 11, from its original vertical position. This contact of the upper end 40 of the wand 38 by the rear hip 42 is immediately discernable to the golfer 12.

One might expect in the initial use of the golf training device 10 to experience a backswing 66 with body sway corresponding to the rotated foot position 68, as shown in FIGS. 11 and 12. With training on the device 10, the golfer 12 will progress to a reduced weight shift, leading to backswing 62 and foot position 64 as shown in FIGS. 9 and 10. Finally with continued training, utilizing the sensitive indication of weight shift to foot position 64, the golfer 12 will be able to retain his foot position 30, as seen in FIG. 8, with the resulting correct backswing 24 of FIG. 2. It is emphasized that, in using the golf training device 10, the golfer 12 may engage in a full-power swing with follow-through without concern for injury or entanglement from a golf training device.

It is though that the golf training device 10 of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A method for improving a golf swing, where the term 'rear', as subsequently used, refers to the side of the golfer, in a normal pre-swing stance, which opposes the intended direction of forward flight of a golf ball to be hit, the method comprising the following steps:

a. placing, as part of the normal pre-swing stance, a rear foot, having an outside edge, a longitudinal center line, and an inside edge, in a position upon a golf training device having two horizontal levels, an upper level and a lower level, which are vertically offset and which adjoin at a step, wherein, with said rear foot in said position, said lower level lies beneath and in contact with the inside edge of said rear foot, said upper level at said step lies beneath and in contact with said rear foot proximate the longitudinal center line of said rear foot, and said upper level lies beneath and vertically separated from the outside edge of the rear foot;

b. swinging a golf club; and c. determining whether said rear foot has shifted from said position, during said golf swing, by pivoting about said upper level at said step, thereby lifting said inside edge from contact with said lower level, indicating an undesirable shift in weight at said rear foot.

2. A method for improving a golf swing, as recited in claim 1, wherein said golf training device additionally includes an elongated member, in the form of a single vertical wand, attached to said base member proximate said outside edge of said rear foot and extending upwardly so as to be adjacently spaced from the rear hip of the golfer in said normal pre-swing stance, said method including the subsequent additional step of:

determining whether the rear hip has come into contact with said elongated member during said golf swing, thereby indicating an undesirable sway of said rear hip.

3. A method for improving a golf swing, where the term 'rear', as subsequently used, refers to the side of the golfer, in a normal pre-swing stance, which opposes the intended direction of forward flight of a golf ball to be hit, the method comprising the following steps:

a. placing, as part of the normal pre-swing stance, a rear foot, having an outside edge, a longitudinal center line, and an inside edge, in a position upon a golf training device having an elongated pivot extending parallel to and upwardly from a surface, so that, with said rear foot in said position, said surface lies beneath and in contact with the inside edge of said rear foot, the elongated pivot lies beneath and in contact with the rear foot proximate the longitudinal center line of said rear foot, and the outside edge of said rear foot lies above and vertically separated from the surface;

b. swinging a golf club; and c. determining whether said rear foot has shifted from said position, during said swing, by pivoting about said elongated pivot, thereby lifting said inside edge of said rear foot from contact with said surface, indicating an undesirable shift in weight at said rear foot.

4. The method for improving a golf swing, as recited in claim 3, wherein said golf training device additionally includes an elongated member attached to said base member and extending upwardly so as to be adjacently spaced from the rear hip of the golfer in said normal pre-swing stance, said method including the subsequent additional step of:

determining whether the rear hip has come into contact with said elongated member during said golf swing, thereby indicating an undesirable sway of said rear hip.

5. A golf training device, in combination with a shoe adapted to be worn on the rear foot of a golfer in a normal pre-swing stance, with the rear foot being the foot on the side of the golfer opposing the intended direction of flight of a golf ball to be hit, comprising:

a. said shoe having an outside edge, a longitudinal center line, and an inside edge;

b. said golf training device having a base member which includes two horizontal shoe-engaging levels, an upper level and a lower level, said levels being vertically offset and mutually adjoining at a step, said upper level at said step forming an elongated pivotal edge;

c. said lower level engaging said inside edge of said shoe from beneath, said elongated pivotal edge engaging proximate said longitudinal center line of said shoe from beneath, and said upper level being vertically spaced beneath said outside edge of said shoe;

d. said shoe pivoting about said elongated pivotal edge, thus lifting and disengaging said inside edge of said shoe from said lower level when actuated by an incorrect weight-shifting golf swing.

6. The golf training device, as recited in claim 5, with the rear hip being the hip of a golfer on the side of the golfer opposing the intended direction of flight of a golf ball to be hit, wherein additionally there is an elongated member in the form of a vertical wand attached to said base member approximate said outside edge of said shoe and extending upwardly so as to be adjacently spaced from the rear hip of the the golfer in a normal pre-swing stance.

7. The golf training device, as recited in claim 5, wherein said shoe-engaging levels include a layer which simulates grass.

8. The golf training device, as recited in claim 5, wherein said step between said lower level and said upper level of the base member is vertical and approximately one-fourth of an inch in height.

9. The golf training device, as recited in claim 5, wherein the base member is formed as a monolithic member.

10. The golf training device, as recited in claim 5, wherein the base member is formed of rubber.

* * * * *